US007004539B1

(12) United States Patent
Hansen et al.

(10) Patent No.: US 7,004,539 B1
(45) Date of Patent: Feb. 28, 2006

(54) SPECTATOR RAIN SHELTER

(76) Inventors: Douglas Hansen, 895 Castle Rock Ct., Richfield, UT (US) 84701; Micki Hansen, 895 Castle Rock Ct., Richfield, UT (US) 84701

( * ) Notice: Subject to any disclaimer, the term of this patent is extended or adjusted under 35 U.S.C. 154(b) by 9 days.

(21) Appl. No.: 10/622,945

(22) Filed: Jul. 18, 2003

(51) Int. Cl.
*A47C 7/66* (2006.01)
*E04H 15/02* (2006.01)

(52) U.S. Cl. ..... 297/184.14; 297/184.11; 135/93; 135/117; 135/900

(58) Field of Classification Search ..... 135/93, 135/96, 117, 900; 297/184.1, 184.11, 184.12, 297/184.14, 184.15
See application file for complete search history.

(56) References Cited

U.S. PATENT DOCUMENTS

| | | | | | |
|---|---|---|---|---|---|
| 3,052,251 | A | | 9/1962 | De Jean, Jr. | |
| 3,155,427 | A | * | 11/1964 | Necessary | 297/184.14 |
| 3,491,781 | A | * | 1/1970 | Reese | 135/141 |
| 3,768,860 | A | * | 10/1973 | Barker | 297/184.14 |
| 3,865,429 | A | * | 2/1975 | Barker | 297/184.14 |
| 3,899,168 | A | * | 8/1975 | Besherse | 472/75 |
| RE29,264 | E | * | 6/1977 | Woodward | |
| 4,035,606 | A | | 7/1977 | Browder | |
| 4,086,931 | A | | 5/1978 | Hall | |
| 4,096,874 | A | * | 6/1978 | Weatherly | 135/124 |
| 4,198,996 | A | * | 4/1980 | Keable et al. | 135/128 |
| 4,685,728 | A | | 8/1987 | Rebollo | |
| 4,716,918 | A | * | 1/1988 | Hayashida et al. | 135/93 |
| 4,958,652 | A | * | 9/1990 | Maya | 135/87 |
| 5,096,214 | A | * | 3/1992 | Walker et al. | 280/47.26 |
| 5,287,872 | A | | 2/1994 | Anderson | |
| 5,331,778 | A | * | 7/1994 | Mazpule et al. | 52/79.5 |
| D378,540 | S | | 3/1997 | Becker | |
| 6,308,466 | B1 | * | 10/2001 | Moriarty | 52/79.5 |
| 6,334,278 | B1 | * | 1/2002 | Arnold | 52/79.1 |
| 6,539,674 | B1 | * | 4/2003 | Arnold | 52/79.1 |
| 2002/0026742 | A1 | * | 3/2002 | Washington | 43/1 |
| 2002/0074030 | A1 | * | 6/2002 | Raines et al. | 135/96 |
| 2003/0010371 | A1 | * | 1/2003 | Langley | 135/117 |

* cited by examiner

*Primary Examiner*—Robert Canfield

(57) ABSTRACT

A spectator rain shelter for personal use at outdoor events for protection from inclement weather includes a portable housing made of a transparent material with a retractable front opening to serve as a window, thereby allowing a person to avoid getting rained on during inclement weather while still enjoying the event they are attempting to watch.

7 Claims, 4 Drawing Sheets

SPECTATOR RAIN SHELTER

BACKGROUND OF THE INVENTION

1. Field of the Invention

The present invention relates to rain shelters and more particularly pertains to a new spectator rain shelter for personal use at outdoor events for protection from inclement weather.

2. Description of the Prior Art

The use of rain shelters is known in the prior art. More specifically, rain shelters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,287,872; U.S. Pat. No. 3,052,251; U.S. Pat. No. 4,035,606; U.S. Pat. No. 4,086,931; U.S. Pat. No. 4,685,728; and U.S. Pat. No. Des. 378,540.

While these devices fulfill their respective, particular objectives and requirements, the aforementioned patents do not disclose a new spectator rain shelter. The inventive device includes a portable housing made of a transparent material with a retractable front opening to serve as a window, thereby allowing a person to avoid getting rained on during inclement weather while still enjoying the event they are attempting to watch.

In these respects, the spectator rain shelter according to the present invention substantially departs from the conventional concepts and designs of the prior art, and in so doing provides an apparatus primarily developed for the purpose of personal use at outdoor events for protection from inclement weather.

SUMMARY OF THE INVENTION

In view of the foregoing disadvantages inherent in the known types of rain shelters now present in the prior art, the present invention provides a new spectator rain shelter construction wherein the same can be utilized for personal use at outdoor events for protection from inclement weather.

The general purpose of the present invention, which will be described subsequently in greater detail, is to provide a new spectator rain shelter apparatus and method which has many of the advantages of the rain shelters mentioned heretofore and many novel features that result in a new spectator rain shelter which is not anticipated, rendered obvious, suggested, or even implied by any of the prior art rain shelters, either alone or in any combination thereof.

To attain this, the present invention generally comprises a portable housing made of a transparent material with a retractable front opening to serve as a window, thereby allowing a person to avoid getting rained on during inclement weather while still enjoying the event they are attempting to watch.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spectator rain shelter apparatus and method which has many of the advantages of the rain shelters mentioned heretofore and many novel features that result in a new spectator rain shelter which is not anticipated, rendered obvious, suggested, or even implied by any of the prior art rain shelters, either alone or in any combination thereof.

It is another object of the present invention to provide a new spectator rain shelter which may be easily and efficiently manufactured and marketed.

It is a further object of the present invention to provide a new spectator rain shelter which is of a durable and reliable construction.

An even further object of the present invention is to provide a new spectator rain shelter which is susceptible of a low cost of manufacture with regard to both materials and labor, and which accordingly is then susceptible of low prices of sale to the consuming public, thereby making such spectator rain shelter economically available to the buying public.

Still yet another object of the present invention is to provide a new spectator rain shelter which provides in the apparatuses and methods of the prior art some of the advantages thereof, while simultaneously overcoming some of the disadvantages normally associated therewith.

Still another object of the present invention is to provide a new spectator rain shelter for personal use at outdoor events for protection from inclement weather.

Yet another object of the present invention is to provide a new spectator rain shelter which includes a portable housing made of a transparent material with a retractable front opening to serve as a window, thereby allowing a person to avoid getting rained on during inclement weather while still enjoying the event they are attempting to watch.

Still yet another object of the present invention is to provide a new spectator rain shelter that is very portable in nature, making it easy to carry along and use.

Even still another object of the present invention is to provide a new spectator rain shelter that completely protects the user's entire body not only from the rain, but also from the chilling effects of the wind.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
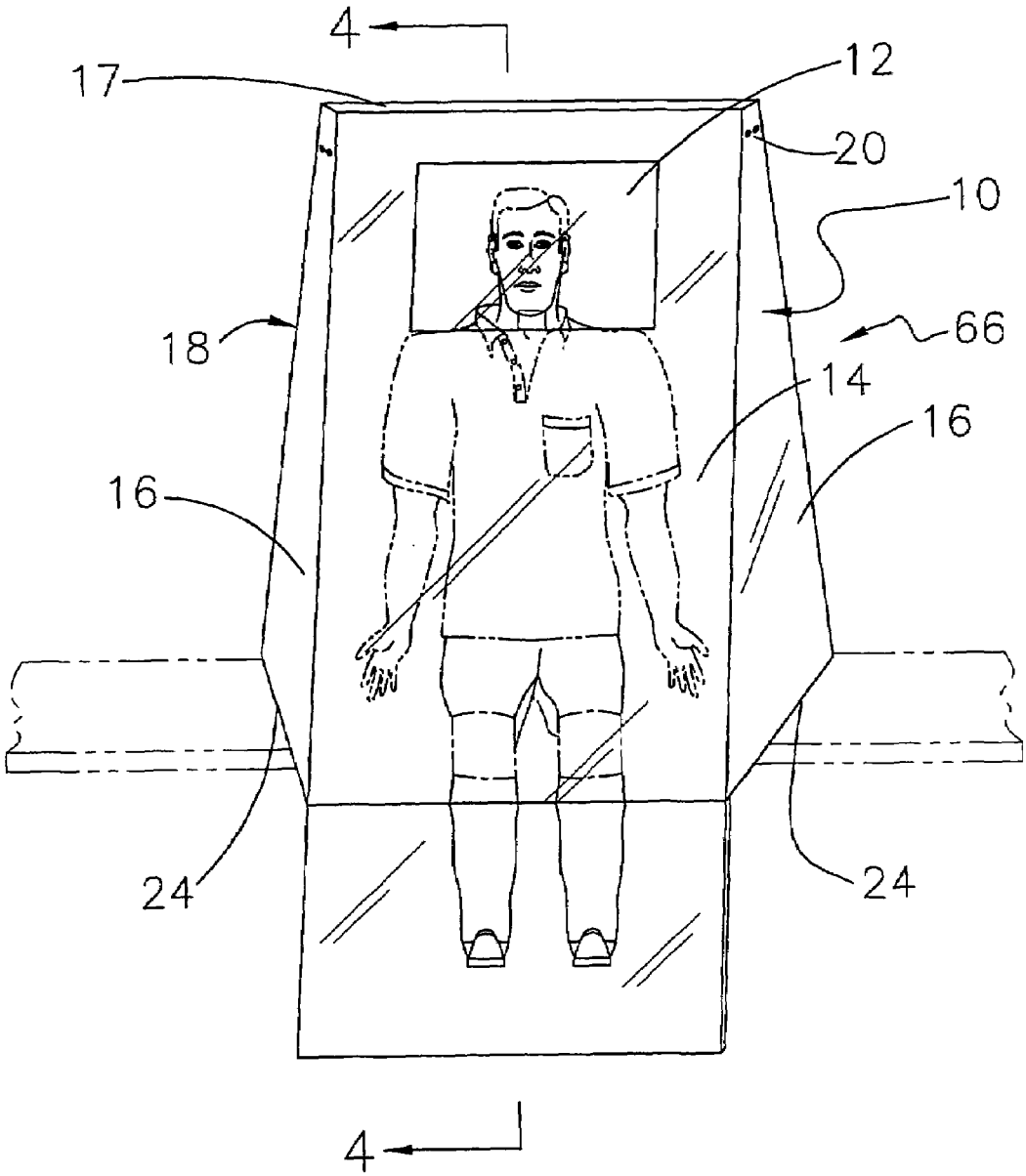
FIG. 1 is a schematic front perspective view of a new one-person spectator rain shelter according to the present invention.
Figure 2:
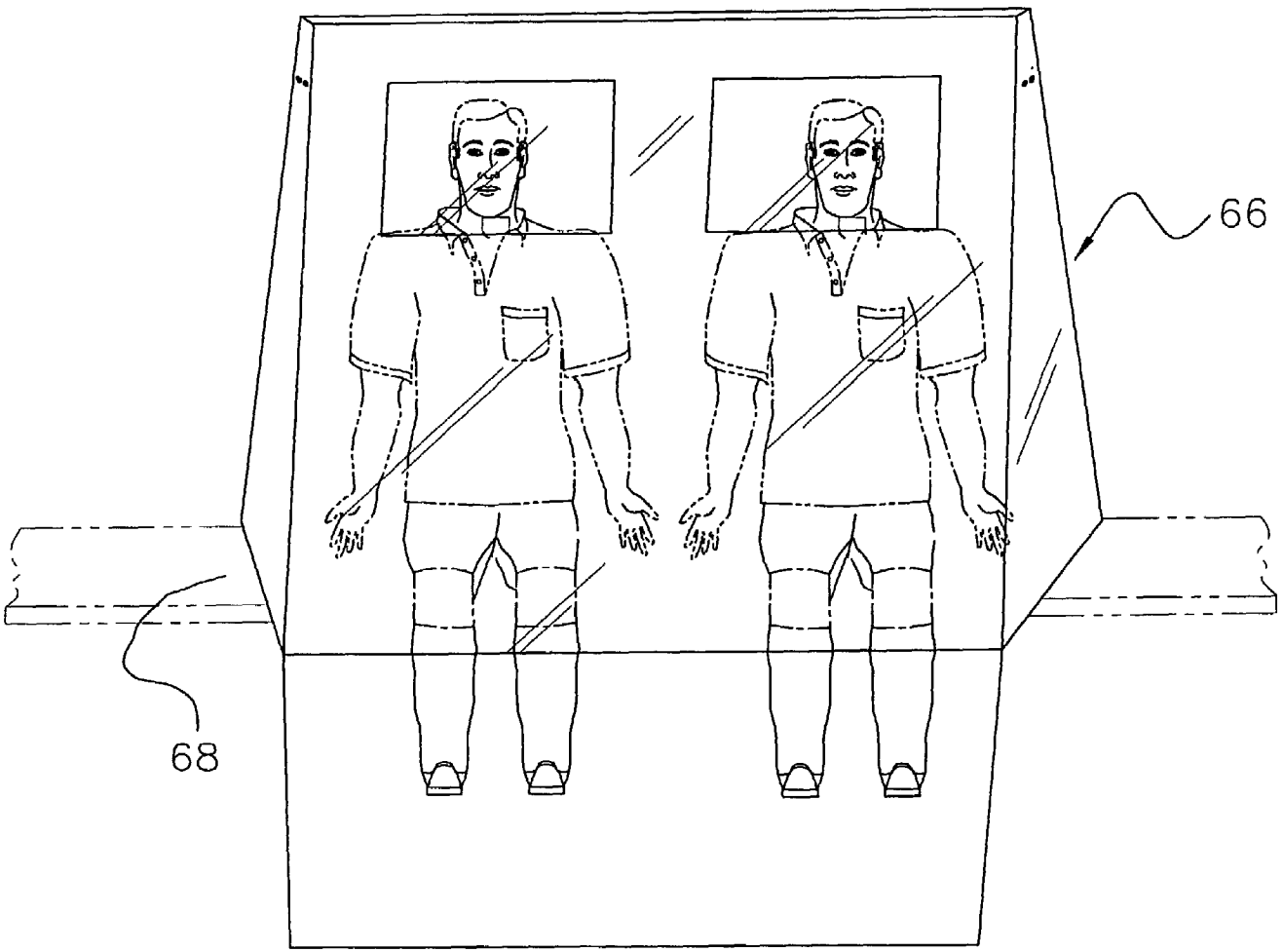
FIG. 2 is a schematic front perspective view of a new two-person spectator rain shelter according to the present invention.
Figure 3:
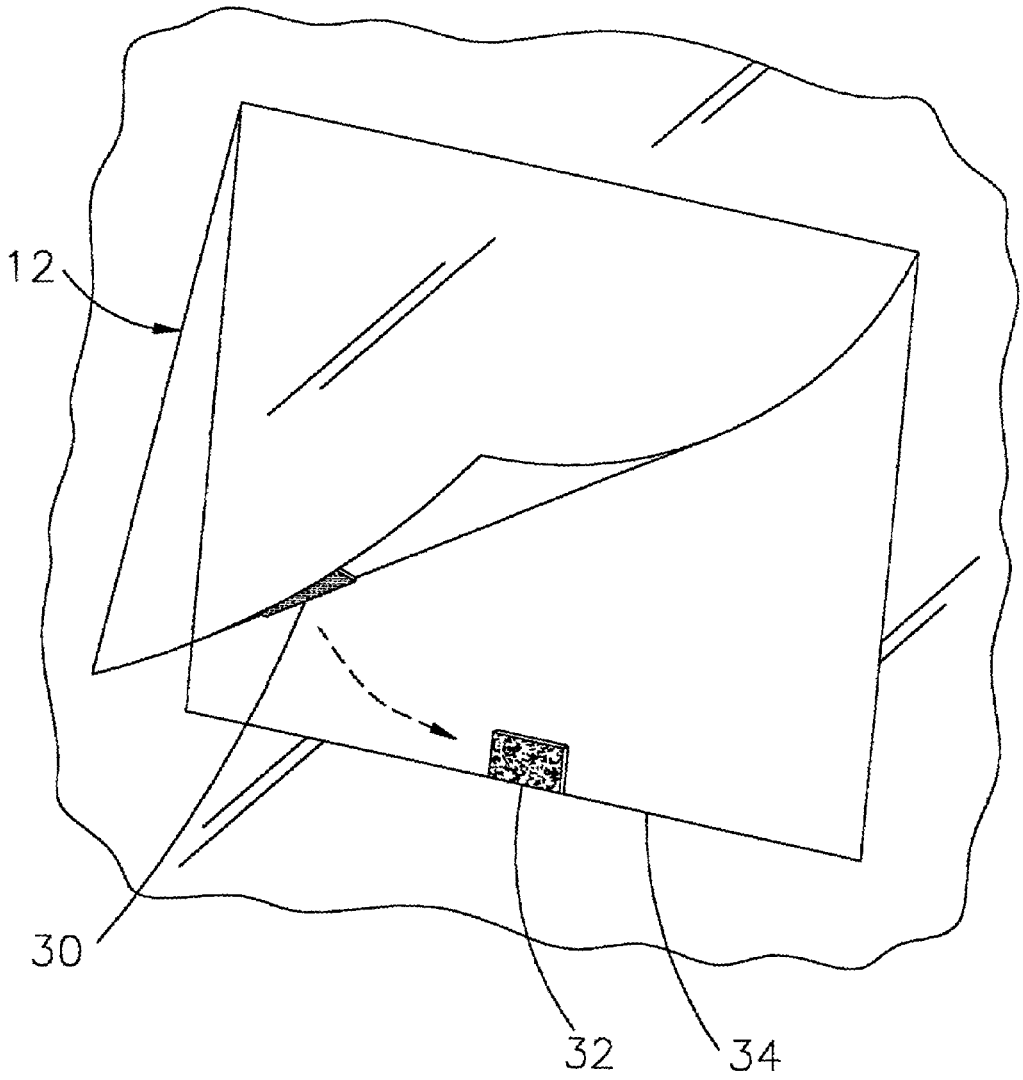
FIG. 3 is a schematic front perspective view of the front window.
Figure 4:
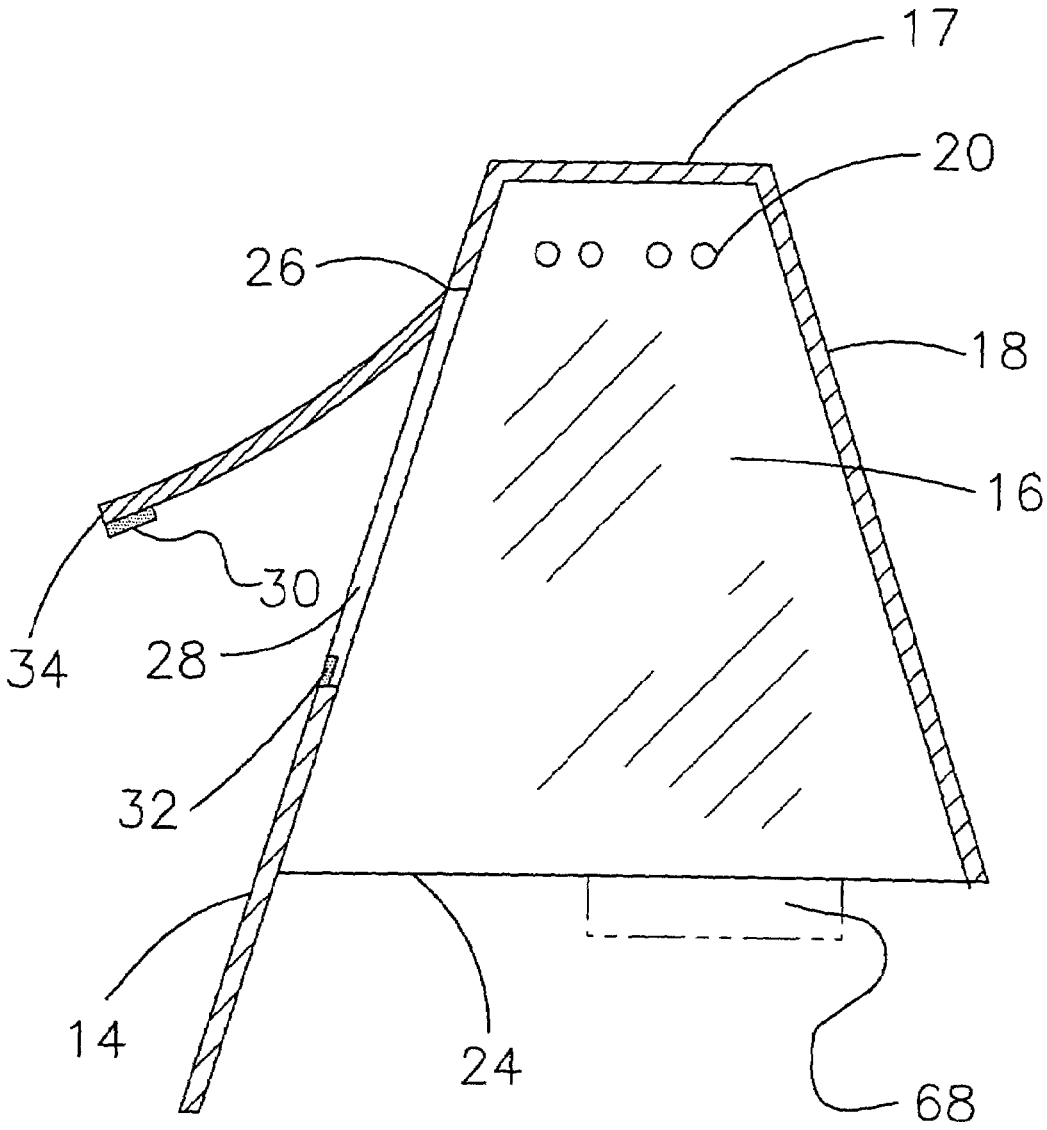
FIG. 4 is a schematic side view of the present invention.

With reference now to the drawings, and in particular to FIGS. 1 through 4 thereof, a new spectator rain shelter embodying the principles and concepts of the present invention and generally designated by the reference numeral 10 will be described.

As best illustrated in FIGS. 1 through 4, the spectator rain shelter 10 generally comprises a housing that has a plurality of walls defining an interior space. The housing 66 is designed for slipping over at least one user, such that the user is positioned within the interior space of the housing 66. The housing 66 is designed for preventing adverse weather from contacting the user when the user is within the interior space of the housing 66.

A window panel 12 is coupled to a front wall 14 of the housing and is designed for permitting the user to view activities outside of the housing 66 when the user is inside it.

The walls of the housing 66 are constructed from a transparent material such that the user can view activities outside of the housing 66 while remaining inside.

The plurality of walls includes a pair of side walls 16, a top wall 17, and a rear wall 18.

The side walls 16 each have a bottom edge 24 designed for resting on a seat 68 such that the housing 66 is supported on the seat 68. They also have ventilation holes 20 positioned close to the top wall 17 of the housing 66 for exhausting warm exhaled air from the user, thus preventing exhaled breath from fogging the window panel 12.

The rear wall 18 is positioned opposite the front wall 14 of the housing and is designed to protect the back of the user.

The front wall 14 has a window opening 28 with the window panel 12 coupled to the upper edge 26 of the window opening 28. The window opening 28 is designed for being pushed out by the user for permitting the user access outside of the housing 66 without the user having to leave the interior space of the housing 66.

A first fastener tab 32 is attached to a lower edge 34 of the window opening 28, with a second fastener tab 30 coupled to the window panel 12. The second fastener tab 30 is for realeasably coupling to the first fastener tab 32 for selectively securing the window panel 12 to the front wall 14.

A plurality of window panels 12 are coupled to the front wall 14. Each window panel 12 is designed for permitting viewing of activities outside of the housing 66 by one of a plurality of users when the users are within the interior space of the housing 66.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A spectator rain shelter for protecting a user from adverse weather when the user is viewing an outdoor weather event, the spectator rain shelter comprising:

a housing having a plurality of walls defining an interior space, said housing being adapted for slipping over at least one user such that the user is positioned within the interior space of said housing, said housing being adapted for preventing adverse weather from contacting the user when the user is within said interior space of said housing, said housing having a bottom opening;

a window panel being coupled to a front wall of said housing, said window panel being adapted for permitting the user to view activities outside of said housing when the user is within said interior space of said housing;

said plurality of walls includes a pair of side walls, a rear wall, and a top wall, said side walls having a bottom edge adapted for resting on a seat such that said housing is supported on the seat;

said front wall and said rear wall diverging from each other from said ton wall toward said bottom opening and said pair of side walls diverging from said front wall toward said back wall such that a front of said housing is smaller than a rear of said housing; and each of said side walls having a plurality of ventilation holes extending through said respective side wall, said ventilation holes being positioned proximate said top wall of said housing such that said ventilation holes ard adapted for exhausting warm exhaled air from the user for preventing the exhaled breath from fogging said window panel, said side walls being positioned on opposing sides of said front wall such that said ventilation holes of said side walls are positioned on opposing sides of the user to inhibit air flow through said ventilation holes from being directed into a face of the user.

2. The spectator rain shelter as set forth in claim 1, further comprising:

a material of said walls of said housing being transparent such that the user can view activities outside of said housing when the user is within said interior space of said housing.

3. The spectator rain shelter as set forth in claim 1, further comprising:

said rear wall being positioned opposite said front wall of said housing such that said rear wall is adapted for protecting a back of the user from adverse weather.

4. The spectator rain shelter as set forth in claim 1, further comprising:

said front wall having a viewing aperture extending through said front wall, said window panel being coupled to an upper edge of said viewing aperture such that said window is adapted for being pushed outwardly by the user for permitting the user access outside of said housing without the user having to leave said interior space of said housing.

5. The spectator rain shelter as set forth in claim 4, further comprising:

a first fastener tab being coupled to a lower edge of said viewing aperture, a second fastener tab being coupled to said window panel such that said second fastener tab is for releasably coupling to said first fastener tab for selectively securing said window panel to said front wall.

6. The spectator rain shelter as set forth in claim 1, further comprising:

a plurality of window panels being coupled to said front wall, each of window panels being for permitting viewing of activities outside of said housing by one of a plurality of users when the users are within said interior space of said housing.

7. A spectator rain shelter comprising:

a housing having a plurality of walls defining an interior space, said housing being adapted for slipping over at least one user such that the user is positioned within the interior space of said housing, said housing being adapted for preventing adverse weather from contacting the user when the user is within said interior space of said housing;

a window panel being coupled to a front wall of said housing, said window panel being adapted for permitting the user to view activities outside of said housing when the user is within said interior space of said housing;

a material of said walls of said housing being transparent such that the user can view activities outside of said housing when the user is within said interior space of said housing;

said plurality of walls includes a pair of side walls, a rear wall, and a top wall, said side walls having a bottom edge adapted for resting on a seat such that said housing is supported on the seat;

said front wall and said rear wall diverging from each other from said top wall toward said bottom opening and said pair of side walls diverging from said front wall toward said back wall such that a front of said housing is smaller than a rear of said housing;

each of said side walls having a plurality of ventilation holes extending through said respective side wall, said ventilation holes being positioned proximate said top wall of said housing such that said ventilation holes are adapted for exhausting warm exhaled air from the user for preventing the exhaled breath from fogging said, window panel, said side walls being positioned on opposing sides of said front wall such that said ventilation holes of said side walls are positioned on opposing sides of the user to inhibit air flow through said ventilation holes from being directed into a face of the user;

said rear wall being positioned opposite said front wall of said housing such that said rear wall is adapted for protecting a back of the user from adverse weather;

said front wall having a viewing aperture extending through said front wall, said window panel being coupled to an upper edge of said viewing aperture such that said window is adapted for being pushed outwardly by the user for permitting the user access outside of said housing without the user having to leave said interior space of said housing;

a first fastener tab being coupled to a lower edge of said viewing aperture, a second fastener tab being coupled to said window panel such that said second fastener tab is for releasably coupling to said first fastener tab for selectively securing said window panel to said front wall;

a plurality of window panels being coupled to said front wall, each of window panels being for permitting viewing of activities outside of said housing by one of a plurality of users when the users are within said interior space of said housing.

* * * * *